US005233892A

United States Patent [19]

Roberts

[11] Patent Number: 5,233,892

[45] Date of Patent: Aug. 10, 1993

[54] QUICK RELEASE MECHANISM FOR TOOLS SUCH AS SOCKET WRENCHES

[76] Inventor: Peter M. Roberts, 3216 Dayton Blvd., Chattanooga, Tenn. 37415

[21] Appl. No.: 959,215

[22] Filed: Oct. 9, 1992

[51] Int. Cl.[5] ..... B25G 3/02

[52] U.S. Cl. ..... 81/177.85; 81/177.2; 279/82; 403/322

[58] Field of Search ..... 81/177.2, 177.85; 279/82, 86, 93, 94; 403/322, 328

[56] References Cited

U.S. PATENT DOCUMENTS

| | | | |
|---|---|---|---|
| 1,569,117 | 1/1926 | Carpenter . | |
| 1,660,989 | 2/1928 | Carpenter . | |
| 1,775,402 | 9/1930 | Mandl . | |
| 1,864,466 | 6/1932 | Peterson . | |
| 2,072,463 | 3/1937 | Mims | 81/125 |
| 2,108,866 | 2/1938 | Mandl | 287/119 |
| 2,721,090 | 10/1955 | Kaman | 287/119 |
| 2,736,562 | 2/1956 | Blackburn | 279/76 |
| 3,011,794 | 12/1961 | Vaughn | 279/76 |
| 3,018,866 | 1/1962 | Elliott et al. | 192/150 |
| 3,069,945 | 12/1962 | Shandel | 81/53 |
| 3,094,344 | 6/1963 | Varga | 287/52.08 |
| 3,156,479 | 11/1964 | Drazick | 279/76 |
| 3,167,338 | 1/1965 | Troike | 287/119 |
| 3,208,318 | 9/1965 | Roberts | 81/177 |
| 3,515,399 | 6/1970 | Wordsworth | 279/93 |
| 3,613,221 | 10/1971 | Pronk | 29/526 |
| 3,777,596 | 12/1973 | Smyers, Jr. et al. . | |
| 3,822,074 | 7/1974 | Welcker | 285/305 |
| 3,890,051 | 6/1975 | Biek | 403/20 |
| 4,367,663 | 1/1983 | Merics . | |
| 4,399,722 | 8/1983 | Sardo, Jr. | 81/60 |
| 4,420,995 | 12/1983 | Roberts | 81/60 |
| 4,480,511 | 11/1984 | Nickipuck . | |
| 4,508,005 | 4/1985 | Herman et al. | 81/177.85 |
| 4,571,113 | 2/1986 | Coren | 81/177.85 X |
| 4,848,196 | 7/1989 | Roberts | 81/177.85 |

FOREIGN PATENT DOCUMENTS

| | | |
|---|---|---|
| 0066710 | 12/1982 | European Pat. Off. . |
| 2121316 | 9/1972 | Fed. Rep. of Germany . |
| 847209 | 10/1939 | France . |

*Primary Examiner*—James G. Smith

[57] ABSTRACT

A tool of the type having a drive stud for receiving and releasing a tool attachment includes an opening in the drive stud and a locking pin movably mounted in the opening. The opening defines upper and lower ends, and the lower end of the opening is located at a portion of the drive stud constructed for insertion into the tool attachment. The lower end of the locking member is constructed to engage the tool attachment when the locking member is positioned in an engaging position and to release the tool attachment when the locking member is moved to a release position. An actuating member is movably positioned on the drive stud, and the actuating member defines a sliding surface oriented transversely to the locking member to engage a ledge surface of the locking member. Movement of the actuating member along the longitudinal axis of the drive stud in a selected direction causes the ledge surface to slide along the sliding surface to move the locking member from the engaging to the release positions.

10 Claims, 3 Drawing Sheets

QUICK RELEASE MECHANISM FOR TOOLS SUCH AS SOCKET WRENCHES

BACKGROUND OF THE INVENTION

This invention relates to torque transmitting tools of the type having a drive stud shaped to receive and release a tool attachment, and in particular to an improved quick release mechanism for securing and releasing a tool attachment to and releasing it from the drive stud.

My previous U.S. Pat. No. 4,848,196 discloses several quick release mechanisms for securing tool attachments such as sockets to torque transmitting tools such as wrenches. In these mechanisms the tool includes a drive stud which defines a diagonally oriented opening, and a locking pin is positioned within the opening so as to move in the opening. In its engaging position, the lower end of the locking pin engages a recess in the socket so as to lock the socket positively in place on the drive stud. When the operator moves the pin in the opening, the lower end of the pin is moved out of contact with the socket, and the socket is released from the drive stud.

In the mechanism shown in FIGS. 1 through 5 of U.S. Pat. No. 4,848,196, the locking pin is held in place by an extension spring which surrounds the shaft of the drive stud. In the version shown in FIGS. 6 and 7, the extension spring is covered by a protective sleeve 70 with flanges 74, 76.

SUMMARY OF THE INVENTION

It is an object of this invention to provide an improved quick release mechanism which is simple in construction; which requires only a few, easily manufactured parts; which is rugged and reliable in use; which automatically accommodates various sockets, including those with and without recesses designed to receive a detent; which substantially eliminates any precise alignment requirements; which is readily cleaned; which presents a minimum of snagging surfaces; and which is low in profile.

This invention represents an improvement in a tool of the type comprising a drive stud for receiving and releasing a tool attachment; wherein the drive stud has an opening therein; wherein a locking member is movably disposed in the opening; wherein the drive stud defines a longitudinal axis and the opening is oriented at a first non-zero skew angle with respect to the longitudinal axis; wherein the opening defines upper and lower ends, the lower end of the opening being located at a portion of the drive stud constructed for insertion into the tool attachment; and wherein the lower end of the locking member is constructed to engage the tool attachment when the locking member is positioned in an engaging position and to release the tool attachment from the drive stud when the locking member is moved to a release position.

According to the present invention, an actuating member is slidably positioned on the drive stud to move along the longitudinal axis. The locking member defines a ledge surface and the actuating member defines a sliding surface positioned to engage the ledge surface. The sliding surface is oriented at a second angle with respect to the longitudinal axis such that movement of the actuating member along the longitudinal axis in a selected direction causes the ledge surface to slide along the sliding surface, thereby moving the locking member in the opening from the engaging to the release positions.

The preferred embodiment described below is unusually simple, compact, rugged and inexpensive to manufacture.

BRIEF DESCRIPTION OF THE DRAWINGS

FIG. 5 illustrates the fact that when one pulls downwardly on the socket while so locked, the pin firmly resists downward movement of the socket and prevents removal of the socket.

DETAILED DESCRIPTION OF THE PRESENTLY PREFERRED EMBODIMENTS

Figure 1:
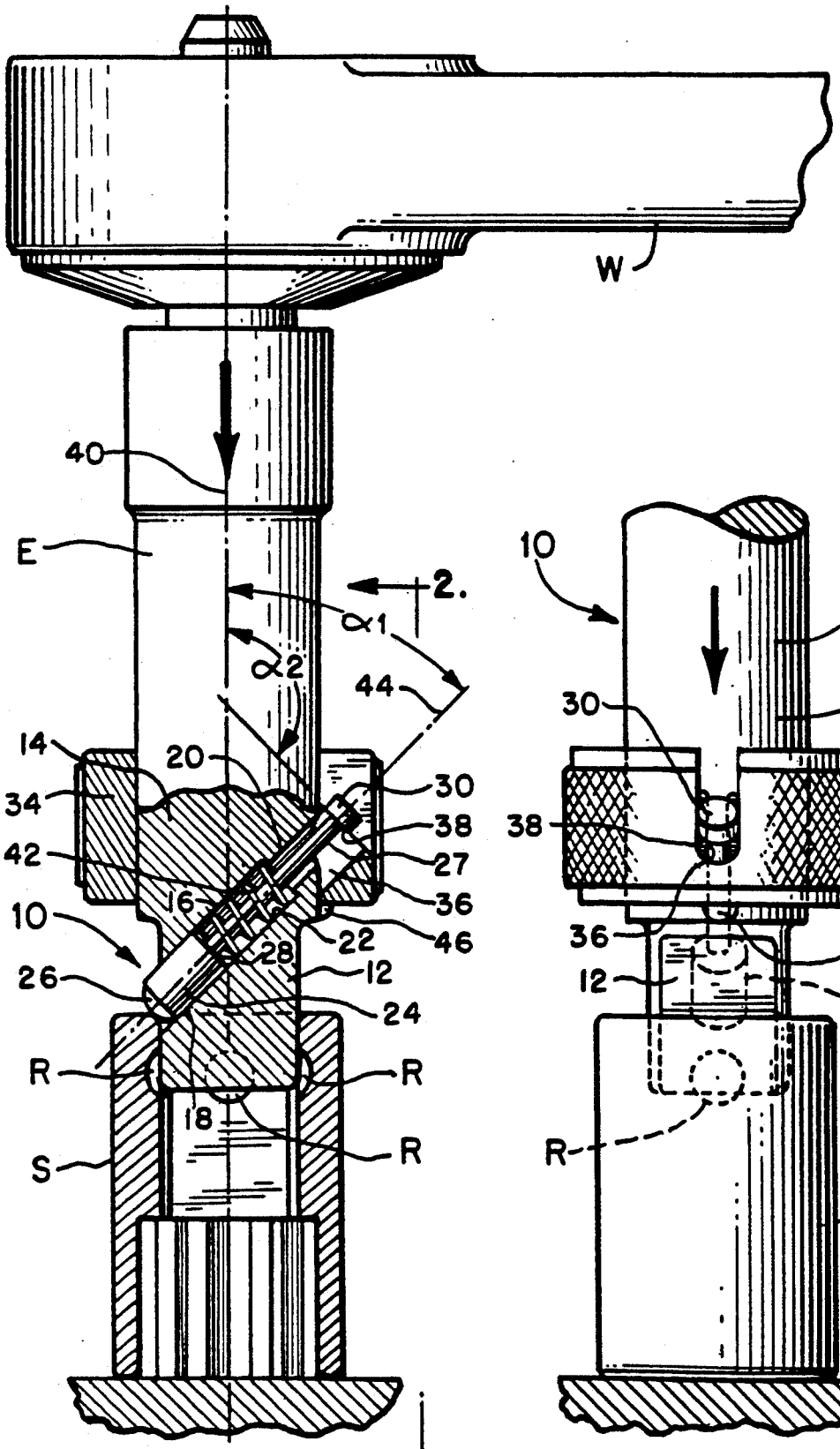
FIG. 1 is a side elevational view partially in cross section of a rachet socket wrench, an extension bar and a socket disposed for attachment to the lower end of the extension bar and showing the presently preferred embodiment of the quick release mechanism of this invention.

Turning now to the drawings, FIG. 1 shows a side elevational view of a tool which in this preferred embodiment is an extension bar E. As shown in FIG. 1, extension bar E is designed to be mounted on a wrench W and to fit into and transmit torque to a socket S. The extension bar E terminates at its lower end in a drive stud 10 having a lower portion 12 and an upper portion 14. The lower portion 12 is constructed for insertion into the socket S, and defines an out-of-round cross section. Typically, the lower portion 12 has a square, hexagonal or other non-circular shape in horizontal cross section. The upper portion 14 will often define a circular cross section, though this is not required.

As shown in FIG. 1, the drive stud 10 is configured to define a diagonally positioned opening 16 having a lower end 18 and a upper end 20. The lower end 18 is positioned in the lower portion 12 of the drive stud 10, and the upper end 20 is positioned in the upper portion 14 of the drive stud 10. The opening 16 has a smaller diameter adjacent the upper end 20 than the lower end 18, and the opening 16 defines a transverse step 22 between the larger and smaller diameter portions of the opening 16.

The foregoing features of the wrench W, extension bar E and socket S are substantially as described in connection with FIGS. 20-25 of my previous U.S. Pat. No. 4,848,196. It may be preferable in some embodiments to provide the opening 16 with a constant diameter, and to define the step 22 in some other manner, as for example with a plug of the type shown in FIG. 20 of my previous U.S. Pat. No. 4,848,196.

As shown in FIG. 1, a locking member such as a pin 24 is slidably positioned in the opening 16. This pin 24 defines a lower end 26 shaped to engage the socket S. The lower end 26 of the pin 24 may be conventionally rounded, or it may alternately be provided with a step as shown in my previous U.S. Pat. No. 4,848,196. Though illustrated as a pin 24, the locking member may take various shapes, including irregular and elongated shapes. If desired, the pin 24 may be provided with an out of round cross section and the opening 16 may define a complementary shape such that a preferred rotational position of the pin 24 in the opening 16 is automatically obtained. The pin 24 defines a reduced diameter neck 27 that terminates at one end at a step 28 and at the other at an enlarged head 30. The underside of the head 30 defines a ledge surface 32 oriented transversely to the length of the pin 24. The ledge surface 32 may be flat, convex, concave or spherical. Similarly, other shapes for the ledge surface 32 are possible so as to allow the ledge surface 32 and sliding surface 38 to cooperate with each other so as to move relative to each other without binding. Furthermore, surface 32 may be discontinuous or have a plurality of surfaces.

Figure 2:
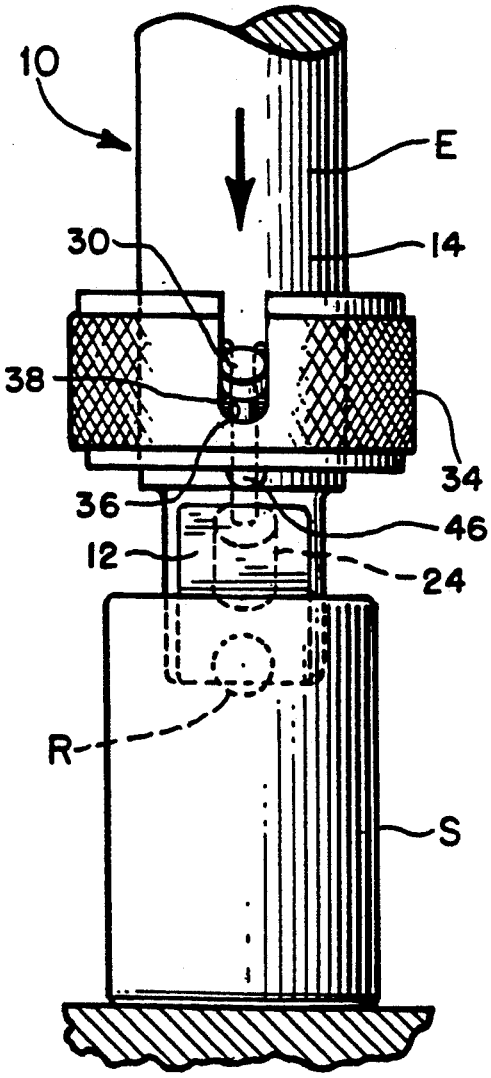
FIG. 2 is a fragmentary side elevational view taken along line 2—2 of FIG. 1.

Also as shown in FIG. 1, an actuation member such as a collar 34 is positioned around the upper portion 14 of the drive stud 10. This collar 34 defines a slot 36 and an adjacent sliding surface 38, as best shown in FIG. 2.

As best shown in FIG. 1, the drive stud 10 defines a longitudinal axis 40, and the collar 34 is guided to move along the longitudinal axis 40. The opening 16 defines an opening axis 44 which is oriented at a first non-zero acute angle $\alpha 1$ with respect to the longitudinal axis 40. The sliding surface 38 is oriented at a second non-zero skew angle $\alpha 2$ with respect to the longitudinal axis. The angles $\alpha 1$ and $\alpha 2$ are preferably supplementary, such that their sum is substantially equal to 180°. With this arrangement, the sliding surface 38 is oriented parallel to the ledge surface 32 and transverse to the pin 24. In other embodiments, the sliding surface 38 may have other shapes, such as a discontinuous surface or a plurality of surfaces, to allow relative movement between sliding surface 38 and ledge surface 32 without binding. Thus, it is contemplated to employ all combinations of shapes for ledge surface 32 and sliding surface 38 which allow them to cooperate with each other so as to move relative to each other without binding.

A spring such as a coil spring 42 biases the pin 24 to the engaging position shown in FIG. 1. As shown, the spring 42 is an extension spring which bears between the step 22 and the step 28 in the locking pin 24, with the neck 27 passing through the spring 42. In alternate embodiments the spring may be implemented in other forms, as for example by means of a leaf spring. Furthermore, if a coil spring is used, it may be employed as either a compression or an extension spring with suitable alterations to the design of FIG. 1, and the spring may be eliminated in some embodiments.

The pin 24, the collar 34 and the spring 42 can be assembled in a straightforward manner on the drive stud 10. First the spring 42 is placed around the neck 27 of the pin 24, and this assembly is then placed in the opening 16 via the lower end 18. The spring 42 is then compressed between the step 28 on the pin 24 and the step 22 in the opening 16 to cause the head 30 to protrude out of the opening 16. Then the collar 34 is moved past the lower portion 12 onto the upper portion 14 of the drive stud 10, with the neck 27 passing through the slot 36, and with the ledge surface 32 sliding on the sliding surface 38. Once the collar 34 is properly seated an impact is used to form an upset 46 on the drive stud 10 so as to capture the collar 34 in place. This completes assembly of the embodiment shown in the Figures described above. In addition, it is contemplated that other means are available for forming upset 46. Furthermore, upset 46 may be formed on collar 34 to capture the collar 34 in place, or other means such as staking may be used.

The pin 24 simultaneously serves a number of separate functions. First, it releasably secures the socket S to the drive stud 10 as described below. Second, the pin 24 engages the slot 36 and thereby limits movement of the collar 34 away from the lower portion 12 of the drive stud 10. The pin 24 cooperates with the upset 46 described below to capture the collar 34 positively in place, and to prevent any undesired rotation of the collar 34.

Though the actuation member is shown as a collar 34 that slides along the longitudinal axis 40, an alternate embodiment of the actuating member may be formed as a slide that does not encircle the drive stud 10.

The operation of the quick release mechanism described above will be apparent from FIGS. 1 through 6. As shown in FIG. 1, when the lower portion 12 of the drive stud 10 is brought into alignment with the socket S, the lower end 26 of the locking pin 24 bears on the socket S.

Figure 3:
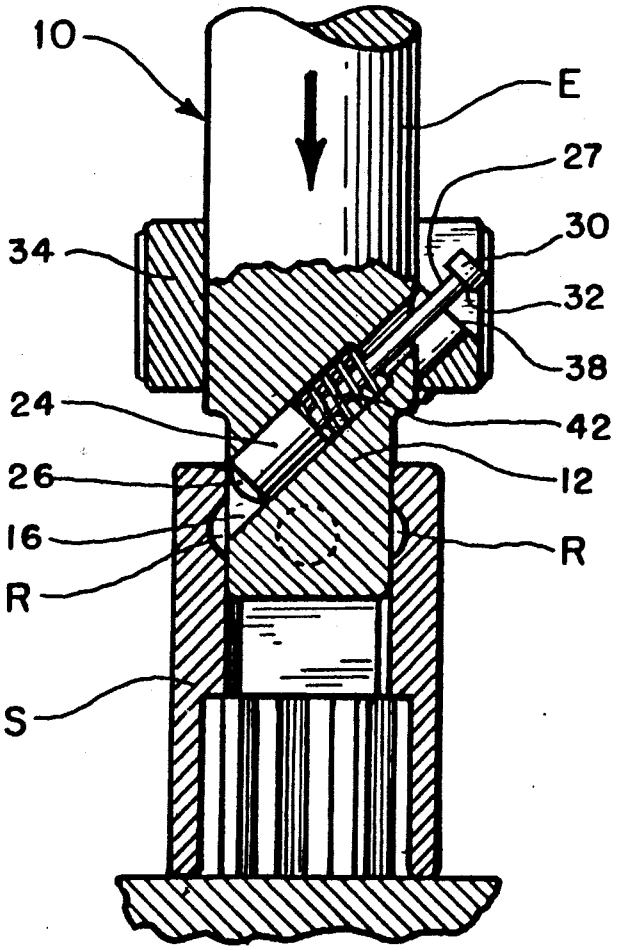
FIG. 3 is a fragmentary side elevational view of the extension bar and the associated socket of FIG. 1 but showing the drive stud of the extension bar partially moved downwardly into the socket and with the locking pin cammed upwardly to allow further downward movement of the drive stud.

As shown in FIG. 3, further downward movement of the drive stud 10 moves the pin 24 inwardly in the opening 16, thereby allowing the lower portion 12 to move within the socket S. This can be done without manipulating the collar 34 in any way.

Figure 4:
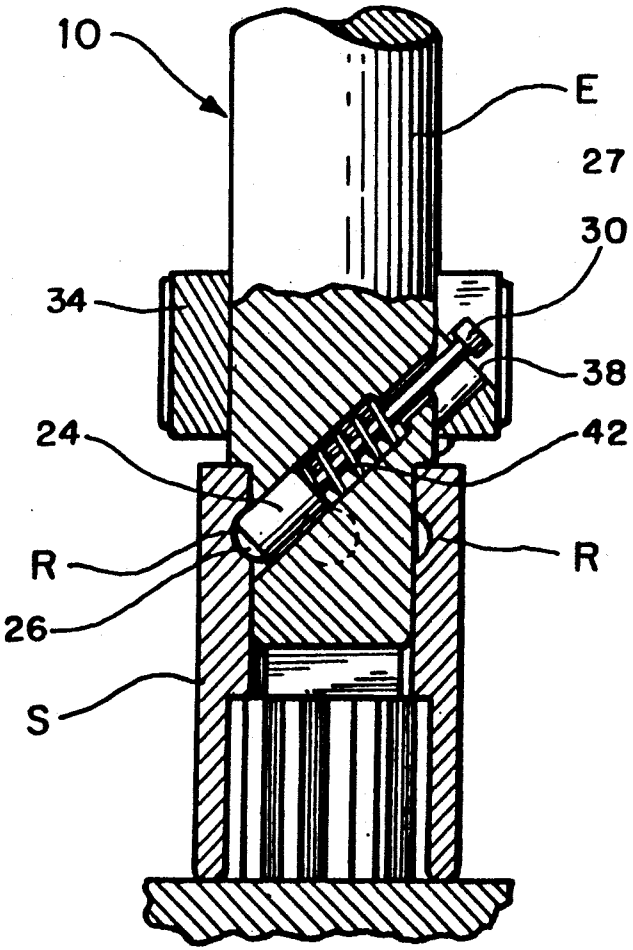
FIG. 4 is a view similar to FIG. 3 showing the drive stud of the extension bar moved downwardly into its final position in the socket with the locking pin restored to its maximum downward position with its lower end projecting into the recess provided in the inner surface of the socket.

As shown in FIG. 4, when the drive stud 10 is fully seated in the socket S, the spring 42 returns the locking pin 24 to the engaging position, in which the lower end 26 of the locking pin 24 engages the recess R in the socket S. The pin 24 will provide at least frictional engagement, even with a socket S which does not include a recess R.

Figure 5:
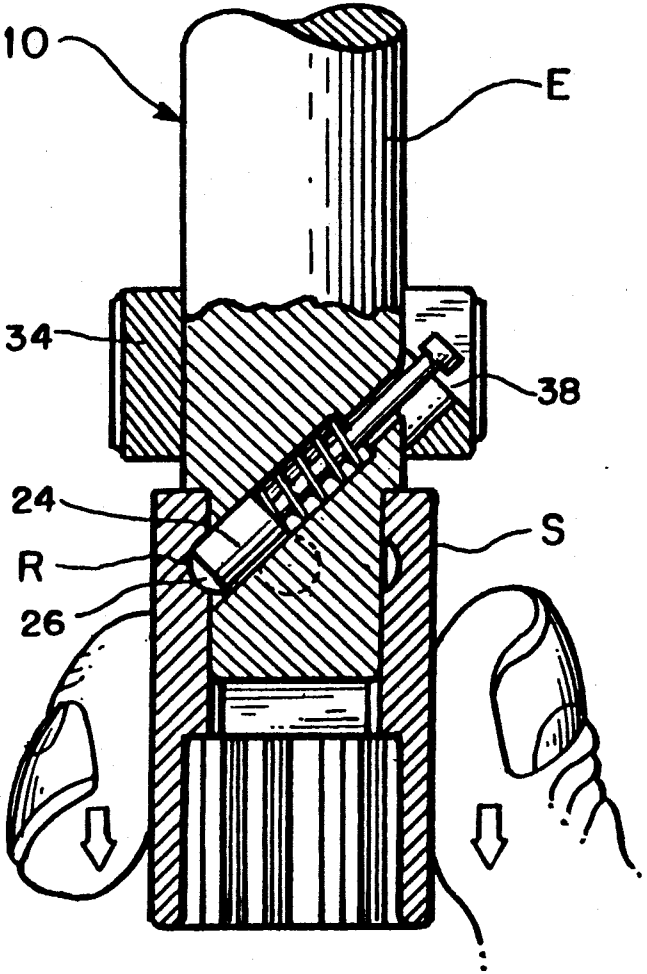
FIG. 5 is a view similar to FIG. 4 showing the relationship of the parts when the socket is positively locked on the drive stud of the extension bar.

As shown in FIG. 5, downward forces on the socket S are not effective to move the locking pin 24 out of its engaging position, and the socket S is positively held in place on the drive stud 10.

Figure 6:
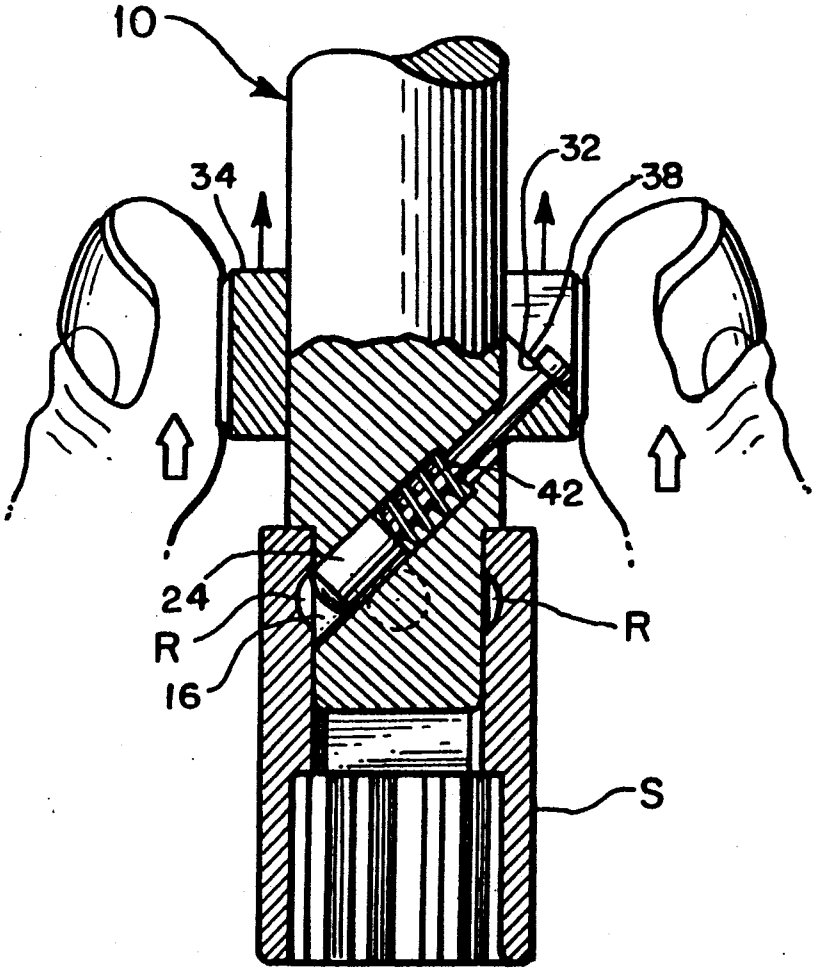
FIG. 6 is a view similar to FIG. 4 but showing that the operator can effect a quick release of the socket by manually lifting the collar surrounding the drive stud and allowing the socket to drop from the drive stud by force of gravity.

As shown in FIG. 6, the collar 34 is raised to release the socket S. This causes the sliding surface 38 to translate under the ledge surface 32, thereby applying a withdrawing force substantially aligned with the length of the opening 16. This withdrawing force is effective to compress the spring 42 and to move the pin 24 from the engaging position of FIG. 5 to the release position of FIG. 6. When the locking pin 24 reaches the release position the socket S is free to fall from the drive stud 10 under the force of gravity.

This invention can be adapted for use with the widest range of torque transmitting tools, including hand tools, power tools and impact tools and impact tools. Simply by way of illustration, this invention can be used with socket wrenches, including those having ratchets, T bar wrenches, and speeder wrenches, all as described and shown in my previous U.S. Pat. No. 4,848,196. Furthermore, this invention is not limited to sockets of the type shown, but can be used with a wide range of tool attachments, including sockets or tool attachments with varying sized recesses R and even on sockets without a recess of any type.

Of course, the quick release mechanism of this invention can be used in any physical orientation, and the terms upper, lower and the like have been used with reference to the orientation shown in the drawings. Furthermore, the terms "engaging position" and "release position" are each intended to encompass multiple positions within a selected range. For example, in the embodiment of FIG. 1 the exact position of the engaging position will vary with the depth of the recess R in the socket S, and the exact position of the release position may vary with a variety of factors, including the extent to which the actuating member is moved.

As suggested above, the present invention can be implemented in many ways, and this invention is not limited to the specific embodiment shown in the drawings. However, in order to define the presently preferred embodiment of this invention the following presently preferred details of construction are provided. These details are of course in no way intended to limit the scope of this invention.

By way of example, the pin 24 may be formed of a material such as a steel of moderate to mild temper, and the collar 34 may be formed of any suitable material such as brass, steel, or other alloy. The angle $\alpha 1$ may range from about 30° to about 45° and the angle $\alpha 2$ may range from about 150° to about 135°, respectively. The width of the sliding surface 38 may be about 5.5 mm; the width of the slot 36 may be about 3 mm; the length of the collar 34 may be about 13 mm; and the cross sectional thickness of the wall of the collar 34 may be about 5 mm.

From the foregoing description it should be apparent that the objects set out initially above have been achieved. In particular, the mechanism shown in the drawings is low profile with respect to the circumference of the extension bar E. The disclosed mechanism is simple to manufacture and assemble, and it requires relatively few parts. It is rugged in operation, and it automatically engages a socket as described above. Because of its design, the mechanism will accommodate various types of sockets, including sockets with various types of recesses or no recess at all. In the illustrated embodiment, the collar 34 may be gripped at any point on its circumference, and does not require the operator to use a preferred angular orientation of the tool. Furthermore, the outer circumference of collar 34 may be knurled as in FIG. 2 to allow manipulation of collar 34 with a single finger.

In the illustrated embodiment, the sliding surface 38 is relatively narrow and confined to a region in the vicinity of the slot 36. Alternately, the sliding surface 38 may be extended laterally, resulting in a crescent shape at the end of the collar 34. Additionally, the slot 36 may extend only partly through the thickness of the collar 34 so that neither the slot 36 nor the pin 24 extends through the outer cylindrical surface of the collar 34. In another embodiment the head 30 only extends through the thickness of the collar 34 when pin 24 is fully withdrawn from its socket holding position. In some alternate embodiments, the locking member may be configured to require a positive action on the part of the operator to retract the locking member as the drive stud is moved into the socket. Certain of these embodiments may require recesses in the sockets as described above to provide all of the functional advantages described.

In the preferred embodiment described above the difference between the first and second angles $\alpha 1$ and $\alpha 2$ is approximately 90°. This minimizes skew forces applied to the pin 24 and minimizes any tendency of pin 24 to bind in the opening 16. However, if friction between the pin 24 and the walls of the opening 16 is sufficiently low, the sliding surface 38 may be positioned at a skew angle with respect to the pin 24, rather than the transverse angle illustrated.

It is intended that the foregoing detailed description be regarded as illustrative rather than limiting, and that it be understood that it is the following claims, including all equivalents, which are intended to define the scope of this invention.

I claim:

1. In a tool comprising a drive stud for receiving and releasing a tool attachment; said drive stud having an opening therein and a locking member movably disposed in said opening; said drive stud defining a longitudinal axis and the opening oriented at a first non-zero angle with respect to the longitudinal axis; said opening defining upper and lower ends, the lower end of said opening being located at a portion of said drive stud constructed for insertion into said tool attachment; the lower end of said locking member being constructed to engage said tool attachment when said locking member is positioned in an engaging position and to release said tool attachment from said drive stud when said locking member is moved to a release position; the improvement comprising:

an actuating member slidably positioned on said drive stud to move along said longitudinal axis;

said locking member defining a ledge surface;

said actuating member defining a sliding surface positioned to engage the ledge surface, said sliding surface oriented at a second angle with respect to the longitudinal axis such that movement of the actuating member along the longitudinal axis in a selected direction causes the ledge surface to slide along the sliding surface, thereby moving the locking member in the opening from the engaging to the release positions.

2. The invention of claim 1 wherein the second angle is a non-zero skew angle; wherein the upper end of said opening is externally open above that portion of said drive stud constructed for insertion into said tool attachment; and wherein said actuating member extends above that portion of said drive stud constructed for insertion into said tool attachment, for receiving manually applied forces from an operator to move said locking member repetitively between said release and engaging positions.

3. The invention of claim 1 or 2 further comprising a spring operative to bias the locking member to the engaging position.

4. The invention of claim 3 wherein said spring comprises a coil spring disposed in said opening, and wherein the locking member passes through said coil spring.

5. The invention of claim 1 or 2 wherein the locking member defines an enlarged head, and wherein the head defines the ledge surface.

6. The invention of claim 1 or 2 wherein the locking member extends through a slot in the actuating member to restrict rotation of the actuating member on the drive stud while allowing translation of the actuating member within a selected range.

7. The invention of claim 1 or 2 wherein said actuating member comprises a collar positioned around the drive stud.

8. The invention of claim 1 or 2 wherein the sliding surface is oriented substantially transverse to the locking member.

9. The invention of claim 2 wherein the sum of the first non-zero angle and the second non-zero skew angle is about 180°.

10. The invention of claim 2 wherein the difference between the first non-zero angle and the second non-zero skew angle is about 90°.

* * * * *

UNITED STATES PATENT AND TRADEMARK OFFICE

CERTIFICATE OF CORRECTION

PATENT NO. : 5,233,892
DATED : August 10, 1993
INVENTOR(S) : Peter M. Roberts

It is certified that error appears in the above-indentified patent and that said Letters Patent is hereby corrected as shown below:

In column 4, line 63, delete the second occurrence of "and impact tools".

Signed and Sealed this

Nineteenth Day of July, 1994

Bruce Lehman

*Attest:*

BRUCE LEHMAN

*Attesting Officer*

*Commissioner of Patents and Trademarks*